US005349975A

United States Patent [19]

Valdner

[11] Patent Number: 5,349,975

[45] Date of Patent: Sep. 27, 1994

[54] AIR COOLED UMBRELLA

[76] Inventor: Vimagda Valdner, 17 Third Ave., Garden City Park, N.Y. 11040

[21] Appl. No.: 144,404

[22] Filed: Nov. 2, 1993

[51] Int. Cl.[5] ..... A45B 3/00

[52] U.S. Cl. ..... 135/16; 135/33.7; 429/123

[58] Field of Search ..... 135/16, 31, 33.7; 429/98, 8, 123

[56] References Cited

U.S. PATENT DOCUMENTS

| | | | |
|---|---|---|---|
| 3,102,547 | 9/1963 | Domina | 135/16 X |
| 3,177,881 | 4/1965 | Covington | 135/16 |
| 3,444,799 | 5/1969 | Covington | 135/16 X |
| 4,023,582 | 5/1977 | Buzzella et al. . | |
| 4,505,285 | 3/1985 | French . | |
| 5,007,811 | 4/1991 | Hopkins | 135/16 |
| 5,143,107 | 9/1992 | Kelley | 135/31 X |
| 5,172,711 | 12/1992 | Mueller et al. | 135/16 |
| 5,207,238 | 5/1993 | Rivera et al. | 135/16 |
| 5,289,839 | 3/1994 | Lombardo | 135/33.7 |

FOREIGN PATENT DOCUMENTS

| | | | |
|---|---|---|---|
| 0928634 | 12/1947 | France | 135/33.7 |
| 2617689 | 1/1989 | France | 135/16 |
| 2085219 | 4/1982 | United Kingdom | 429/123 |

*Primary Examiner*—Lanna Mai
*Attorney, Agent, or Firm*—Richard L. Miller

[57] ABSTRACT

An air cooled umbrella is provided having a rod, a handle with a handgrip, a top spring, a runner, a plurality of stretchers, and a collapsible canopy. A plurality of flat ribs are under the canopy. Each flat rib has a plurality of holes therethrough for venting hot air from under the canopy when opened. An electric fan is built into the rod directly under the canopy, so as to speed up the venting of the hot air and to supply cool air to a person under the canopy. The fan may be supplied power from a solar cell panel mounted on the canopy of the umbrella or alternatively from a separate rechargeable handle battery pack. The separate rechargeable handle battery pack may be charged by either the solar cell panel or a separate house current wall socket charger assembly.

7 Claims, 1 Drawing Sheet

AIR COOLED UMBRELLA

BACKGROUND OF THE INVENTION

The instant invention relates generally to umbrellas and more specifically it relates to an air cooled umbrella.

Numerous umbrellas have been provided in prior art that are each adapted to vent air trapped within the canopy, thereby reducing discomfort to persons seated beneath the canopy. For example, U.S. Pat. Nos. 4,023,582 to Buzzella et al., 4,505,285 to French and 5,007,811 to Hopkins all are illustrative of such prior art. While these units may be suitable for the particular purpose to which they address, they would not be as suitable for the purposes of the present invention as heretofore described.

SUMMARY OF THE INVENTION

A primary object of the present invention is to provide an air cooled umbrella that will overcome the shortcomings of the prior art devices.

Another object is to provide an air cooled umbrella in which its canopy ribs are flat and perforated, to allow the venting of hot air from under the canopy, while the canopy can still protect the person it covers.

An additional object is to provide an air cooled umbrella in which a fan which can be solar powered and battery powered and is built into the umbrella rod directly under the canopy, so as to speed up the venting of the canopy and to supply cool air to the person under the canopy.

A further object is to provide an air cooled umbrella that is simple and easy to use.

A still further object is to provide an air cooled umbrella that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
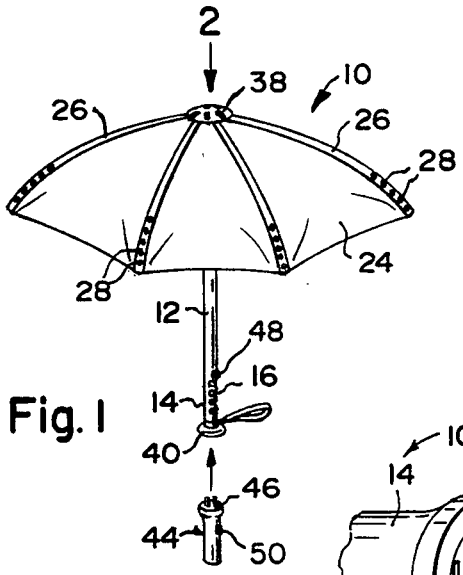
FIG. 1 is a diagrammatic perspective view of the instant invention.
Figure 2:
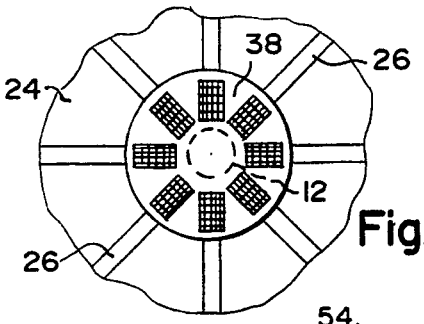
FIG. 2 is a top elevational view taken in the direction of arrow 2 in FIG. 1 with parts broken away.
Figure 3:
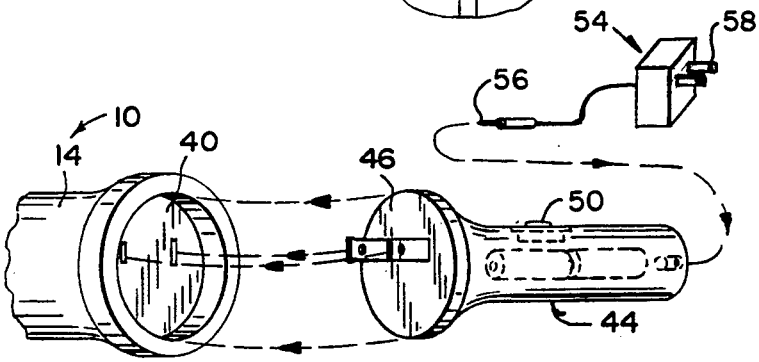
FIG. 3 is an enlarged diagrammatic perspective view illustrating the rechargeable handle battery pack.
Figure 4:
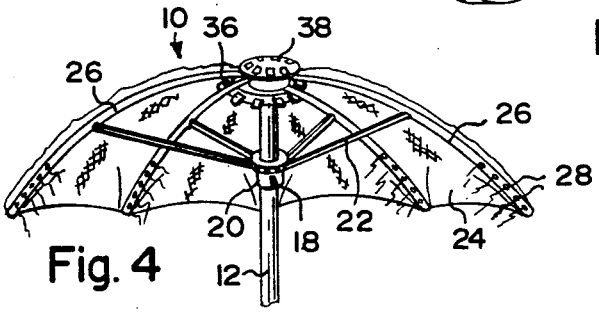
FIG. 4 is an enlarged perspective view illustrating the relationship between the cooling components of the instant invention.
Figure 6:
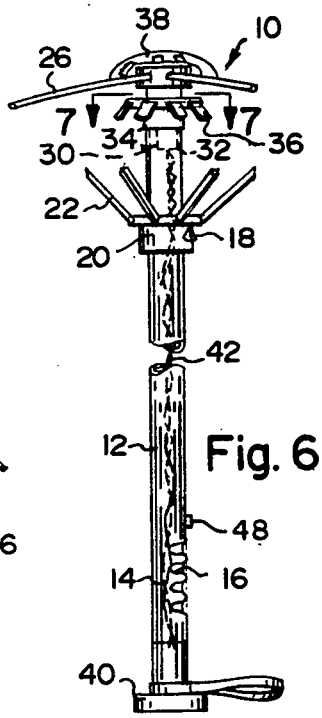
FIG. 6 is an enlarged elevational view with some parts shown in phantom and other parts broken away illustrating the instant invention in a fully open state.
Figure 7:
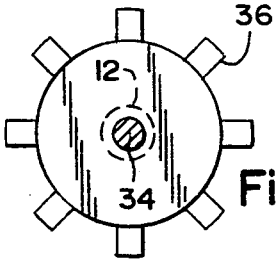
FIG. 7 is a greatly enlarged cross sectional view, with parts broken away, taken on line 7—7 in FIG. 6 of just the fan blade assembly per se.
Figure 5:
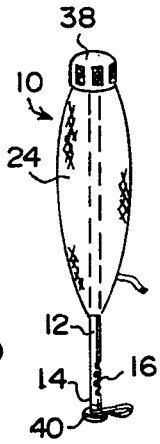
FIG. 5 is a perspective view illustrating the instant invention in a folded state.
Figure 8:
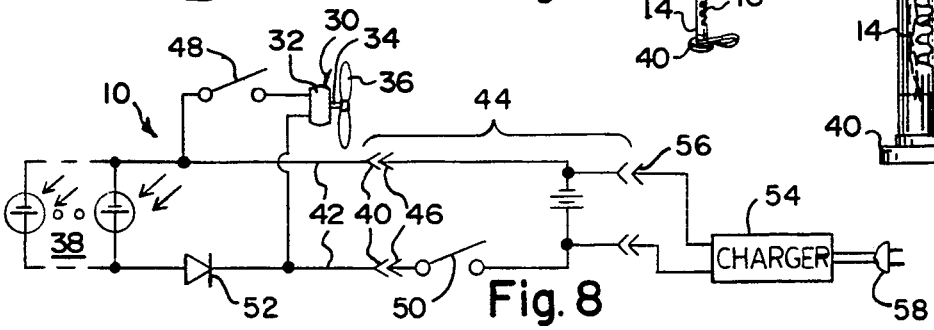
FIG. 8 is an electrical schematic diagram of the instant invention.

Turning now descriptively to the drawings, in which similar reference characters denote similar elements through the several views, FIGS. 1 through 8 illustrate an air cooled umbrella 10 having a rod 12, a handle 14 with a handgrip 16, a top spring 18, a runner 20, a plurality of stretchers 22 and a collapsible canopy 24. A plurality of flat ribs 26 are incorporated in the canopy and extend from upper to lower surfaces thereof. Each flat rib 26 has a plurality of holes 28 therethrough through which hot air is vented from under the canopy 24 when opened.

An electric fan 30 is built into the rod 12 directly under the canopy 24, so as to speed up the venting of the hot air and to supply cool air to a person under the canopy 24. Solar cell panel 38 is mounted to the apex of the canopy 24 and is electrically connected to the motor 32, so as to supply power to said electric fan 30 on hot sunny days. The electric fan 30 includes a motor 32 with transmission assembly 34 carried at a top end of the rod 12. A fan blade assembly 36 is connected to the transmission assembly 34 and is rotatable on the top end of the rod 12, under the canopy 24 of the umbrella 10. The transmission assembly 34 permits rod 12 to pass through the assembly and allows the fan blade assembly 36 to rotate in a concentric fashion about the rod 12.

The air cooled umbrella 10 further contains an electric socket 40 on a bottom end of the handle 14 electrically connected to the motor 32 via wires 42 in the rod 12. A rechargeable handle battery pack 44 has an electric plug 46 on one end to be inserted into the electric socket 40, so as to supply power to the electric fan 30 on hot sunless days and nights. The rechargeable handle battery pack 44 may be charged utilizing separate charger assembly 54, which has plugs 56 and 58 for respectively plugging into the rechargeable handle battery pack 44 and an electric house wall socket (not shown) as well known in the art or in the alternative by the solar cell panel 38.

OPERATION OF THE INVENTION

A switch 48 permits the fan to activated or deactivated as desired by the user. If there is an adequate amount of sun shining on the solar cell panel 38 this may be sufficient to operate the fan 30 directly. If it is desired to operate on the rechargeable battery switch 50 must also be in a closed position. Diode 52 permits the fan to be automatically operated from the solar cell panel when switch 50 is in an open position and yet allows batteries 44 to operate the fan when switch 50 is in a closed position. If desired it is possible to also charge the batteries 44 utilizing the solar cell panel 38 if switch 48 is left open, simultaneously while switch 50 is closed and the device is place in an adequate amount of sun light for a sufficient amount of time.

To use the air cooled umbrella 10 on a hot sunny day a person simply opens the umbrella and places the canopy 24 above oneself. Hot air accumulating under the canopy and rising as a result of convection and which would otherwise be trapped under the canopy, is able to pass through the holes in the ribs and therefore is vented by the holes completely through the canopy. The electric fan 30 will receive power from the solar cell panel 38, so that the motor 32 will rotate the fan blade assembly 36. This will speed up the venting of hot air through the holes 28 in the flat ribs 26 and cool off the person under the canopy. On hot sunless days and nights the electric plug 46 of the rechargeable handle battery pack 44 may be inserted into the electric socket 40 to now supply power to the electric fan 30.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An air cooled umbrella comprising a rod having opposite top and bottom ends, a handle with a hand grip on the bottom end of the rod, a runner mounted on the rod, a collapsible canopy mounted on the rod adjacent the top end thereof and incorporating a plurality of elongate flat ribs, a plurality of stretchers extending between the canopy and flat ribs, each of the flat ribs being formed along its length with a plurality of holes extending through the canopy for venting hot air from under the canopy, through the canopy, when opened.

2. An air cooled umbrella as recited in claim 1, further including an electric fan built into the rod directly under the canopy, so as to speed up the venting of the hot air and to supply cool air to a person under the canopy.

3. An air cooled umbrella as recited in claim 2, wherein said electric fan includes:

a) a motor with transmission assembly carried within a top end of the rod; and b) a fan blade assembly connected to said transmission assembly and rotatable on the top end of the rod.

4. An air cooled umbrella as recited in claim 3, further including a solar cell panel mounted to the apex of the capopy and electrically connected to said motor, so as to supply power to said electric fan on hot sunny days.

5. An air cooled umbrella as recited in claim 4, further including:

a) an electric socket on a bottom end of said handle electrically connected to said motor; and b) a rechargeable handle battery pack having an electric plug on one end to be inserted into said electric socket, so as to supply power to said electric fan on hot sunless days and nights.

6. An air cooled umbrella as recited in claim 5, further including:

a) means for alternatively permitting electric power for activating said electric fan to be selected from said solar cell panel or said rechargeable handle battery pack; and b) means for alternatively permitting said rechargeable handle battery pack to be charged from either said solar cell panel or a separate charger assembly.

7. An air cooled umbrella comprising a rod having opposite top and bottom ends, a runner mounted on the rod, a collapsible canopy mounted on the rod adjacent the top end thereof, and a plurality of stretchers extending between the canopy and the runner, the canopy incorporating a plurality of flat ribs, each being formed with at least one hole extending through the canopy for venting hot air from under the canopy, through the canopy, when opened.

* * * * *